United States Patent [19]

Rietdijk et al.

[11] Patent Number: 4,950,192

[45] Date of Patent: Aug. 21, 1990

[54] METHOD OF MANUFACTURING OF COLOR DISPLAY TUBE

[75] Inventors: Johan A. Rietdijk; Piet C. J. Rens, both of Eindhoven, Netherlands

[73] Assignee: U.S. Philips Corporation, New York, N.Y.

[21] Appl. No.: 389,670

[22] Filed: Aug. 4, 1989 (Under 37 CFR 1.47)

[30] Foreign Application Priority Data

Aug. 4, 1988 [NL] Netherlands ..... 8801944

[51] Int. Cl.[5] ..... H01J 9/44

[52] U.S. Cl. ..... 445/3; 445/30; 219/64

[58] Field of Search ..... 445/30, 3, 4; 219/121.14, 121.64

[56] References Cited

U.S. PATENT DOCUMENTS

| | | | |
|---|---|---|---|
| 3,643,299 | 2/1972 | Brown | 445/3 |
| 4,663,561 | 5/1987 | Brunn | 313/406 |
| 4,854,905 | 8/1989 | Shibuya et al. | 445/30 |
| 4,866,334 | 9/1989 | Fendley et al. | 445/30 |

*Primary Examiner*—Kenneth J. Ramsey
*Attorney, Agent, or Firm*—John C. Fox

[57] ABSTRACT

A method of manufacturing a color display tube in which after the envelope is formed the shadow mask is displaced relative to the display window via movable positioning members provided in the envelope. After the color display tube is assembled a test pattern is displayed on the display screen and is optimized by means of positioning members 23, such that the shadow mask is accurately aligned relative to the display screen 6. The adjusted position is fixed by forming a number of welds, using a laser 33, between the connection means 12 and the support elements 10 in the display window 1.

15 Claims, 7 Drawing Sheets

METHOD OF MANUFACTURING OF COLOR DISPLAY TUBE

BACKGROUND OF THE INVENTION

The invention relates to a method of manufacturing a colour display tube, in which a display window is provided with a display screen of phosphor elements luminescing in different colours, a shadow mask having a large number of apertures is suspended in the display window, and an eveloping part is secured to the display window in such a way that an envelope is formed.

Such a method is described in British Patent Specification 2,097,996. In this method pins are provided in the corners of the display window suspension elements are provided at the corners of the shadow mask, and the mask is suspended in the display window by fitting each suspension element on a pin by means of a wire spring.

As is known, the display window is provided with a display screen of phosphor elements luminescing in different colours by a photolithographic process using the shadow mask as a photomask.

In securing the enveloping (cone) part to the display window and during evacuation of the envelope, the envelope is heated to approximately 400° C. During heating the shadow mask expands and it has been found in practice that when the envelope has cooled the shadow mask does not always resume its original position. As a result of this, the apertures in the shadow mask may be displaced relative to the phosphor elements of the display screen leading to colour defects in the colour display tube.

OBJECTS AND SUMMARY OF THE INVENTION

One of the objects of the invention is to provide a method of manufacturing a colour display tube, in which colour defects in an amage to be displayed are substantially completely precluded.

To this end, a method of the type described in the opening paragraph is characterized according to the invention in that after the envelope is formed, the shadow mask is displaced relative to the display window by means of movable positioning elements, until the shadow mask is in a desired position after which is fixed by fixation means. By virtue of the movable positioning elements the shadow mask can be displaced in all directions relative to the display window in a simple manner and independent of the fixation elements. The fixation elements fix the accurately adjusted position, against unfavourable influences such as vibrations and shocks.

A preferred embodiment of a method in accordance with the invention is characterized in that a test pattern generated by an electrode system which is accommodated in the enveloping part is displayed on the display screen via the shadow mask, and is used to determine an accurate alignment of the shadow mask relative to the display screen, as a result of which the colour display tube operates satisfactorily.

Another preferred embodiment of a method in accordance with the invention is characterized the shadow mask is provided in that with connection means for connecting the shadow mask to the movable positioning elements, and in that the shadow mask is displaced by displacing the connection means. This enables the shadow mask to be connected to the positioning elements in a simple manner, and to be displaced relative to the display window, in such a manner that the shadow mask experiences no local deformation.

A further preferred embodiment of a method according to the invention, in which the shadow mask is suspended from supporting elements which are provided in the display window, is characterized in that during the displacement each connection means remains in contact with the associated support element, and in that the desired position is fixed by connecting each connection means to the associated support element. This enables the desired position of the shadow mask to be fixed rapidly and accurately.

A further preferred embodiment of a method in accordance with the invention, in which the shadow mask is suspended relative to the display window in a readily movable manner, is characterized in that for each of the connection means a resilient element is used having a slide plate with an aperture, which slide plate can be moved relative to the flat resilient element, and for each of the support elements a pin is used which is fitted in the display window and which has a free end, the shadow mask being suspended in the display window in such a manner that the free end of the pin projects from the aperture in the slide plate, and the position is fixed by fixing each slide plate to the associated pin.

Once the shadow mask is positioned relative to the display window, any changes in the adjusted position must be avoided, i.e. the shadow mask must be rapidly and accurately secured to the display window in the said position, which is obtained in a preferred embodiment of a method in accordance with the invention by means of laser welds, so that, for example, each slide plate is secured to the associated resilient element and the associated pin.

A further preferred embodiment of a method in accordance with the invention is characterized in that positioning members extend through apertures in the envelope, and the desired position of the shadow mask is fixed by adjusting and fixing each positioning member relative to the envelope.

A further preferred embodiment of a method in accordance with the invention is characterized in that besides positioning the shadow mask relative to the display window the positioning members can very suitably be used to support the shadow mask in the display window.

An alternative embodiment of a method in accordance with the invention, in which the shadow mask can be readily positioned relative to the display window is characterized in that the display window is provided with apertured recesses which are at least partly spherical, each of the positioning members is provided with an at least partly spherical portion which fits in a recess, and each aperture is sealed in a vacuum tight manner by an elastic element. The elastic element enables the spherical portion of the positioning member to be rotated in the recess, while maintaining a vacuum in the envelope.

An alternative preferred embodiment of a method in accordance with the invention, in which the shadow mask can be readily positioned relative to the display window after the envelope has been formed is characterized in that the positioning elements which displace the shadow mask relative to the display window are controlled by means of a localised supply of energy. In this way displacing the shadow mask relative to the display window is obtained, while maintaining a vacuum in the envelope.

A further preferred embodiment of a method in accordance with the invention is characterized in that the supply of energy takes place as a function of irradiation by an electron beam generated by an electrode system which is accommodated in the enveloping part. The use of the electrode system for generating the test pattern as well as applying energy to the position determining means provides an elegant method of manufacturing a colour display tube.

In yet another preferred embodiment of a method in accordance with the invention each of the position determining means is composed of two juxtaposed spaced apart metal strips, one end of the strips being connected to the display window and the other end being connected to the associated connection means. In an alternative embodiment, a bimetal strip is used for each of the means, one end of the strip being connected to the display window and the other end being connected to the associated connection means.

In still another preferred embodiment of a method in accordance with the invention, each support element is provided with a metal part and one end of each strip is secured to this metal part and the other end of each strip is secured to the associated connection means, the connection means lies against the metal part, and the desired position is fixed by securing each connection means to the associated metal part.

BRIEF DESCRIPTION OF THE DRAWINGS

The invention will now be explained in greater detail with reference to the drawings, in which.

DESCRIPTION OF PREFERRED EMBODIMENTS

Figure 1:
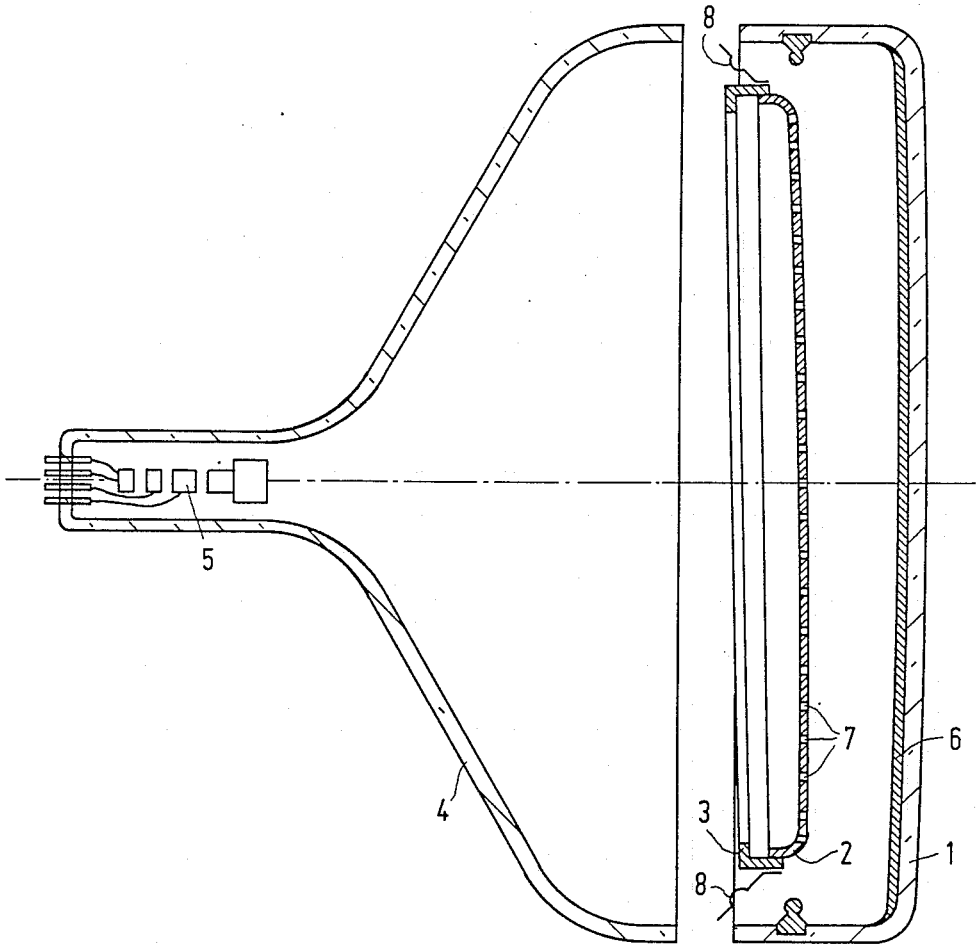
FIG. 1 is a diagrammatic sectional view of parts of a colour display tube before the envelope is formed.

FIG. 1 diagrammatically shows the parts of a colour display tube before they are assembled. These parts are a display window 1, a shadow mask 2 secured to a frame 3 and a conical enveloping part 4 provided with an electrode system 5 comprising three electron guns. The display window 1 is provided with a display screen 6 comprising a large number of phosphor elements luminescing in red, green and blue. The phosphor elements may be in the form of, for example, dots or strips; the longitudinal direction of which extends perpendicularly to the plane through the electron guns of the electrode system 5. The shadow mask 2, which is provided with a large number of apertures 7, is fixed on a frame 3. The electrode system 5 for generating three electron beams is housed in the enveloping part 4 which, by way of example, is conically shaped in the present embodiment but which may be box-shaped in another embodiment of the invention.

In the manufacture of a colour display tube these parts must be accurately positioned relative to one another and assembled to form an envelope, such that electron beams generated by the electrode system 5 impinge on the associated phosphor elements via apertures 7 in the shadow mask. One way of obtaining this accurate positioning is described in British Patent Specification 2,097,996.

When the parts are accurately positioned relative to one another they are fixed to one another, a glass frit generally being interposed, such that an envelope is formed which is subsequently evacuated. During fixing and evacuating, in which process the colour display tube is heated to approximately 400° C., it is possible that the shadow mask is moved from its accurate position relative to the display screen.

In accordance with the inventive method, this adverse displacement can be compensated by accurately positioning the shadow mask relative to the display window after the envelope is formed, and fixing the adjusted position. In addition, the method according to the invention enables the position of the shadow mask to be adjusted before teh envelope is evacuated, and to fix this position in such a manner that during and after the evacuation process substantially no change occurs in the fixed position. By way of example, an embodiment of a method in accordance with the invention will be described with reference to FIGS. 2, 3 and 4.

Figure 2:
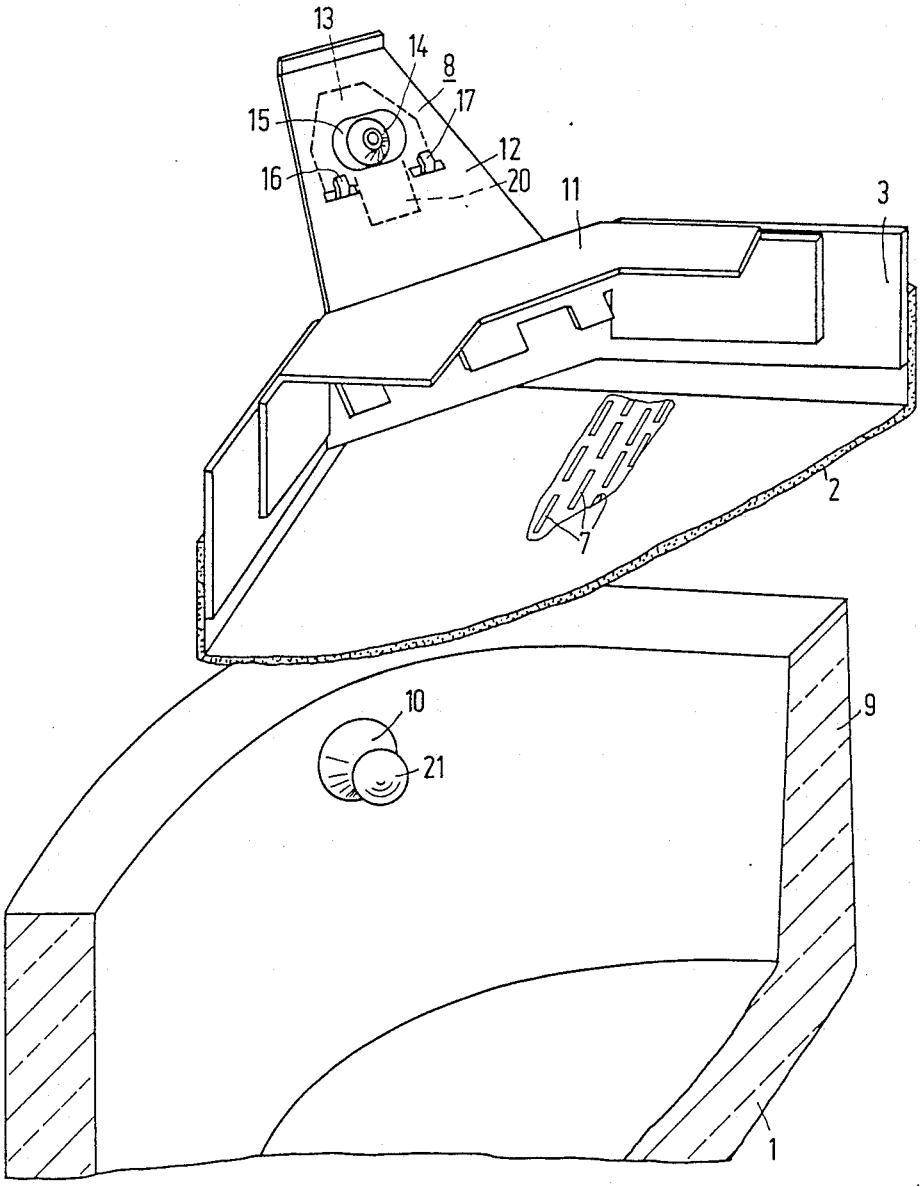
FIG. 2 is a diagrammatic perspective view of an embodiment of a suspension of the shadow mask in the display window.
Figure 3:
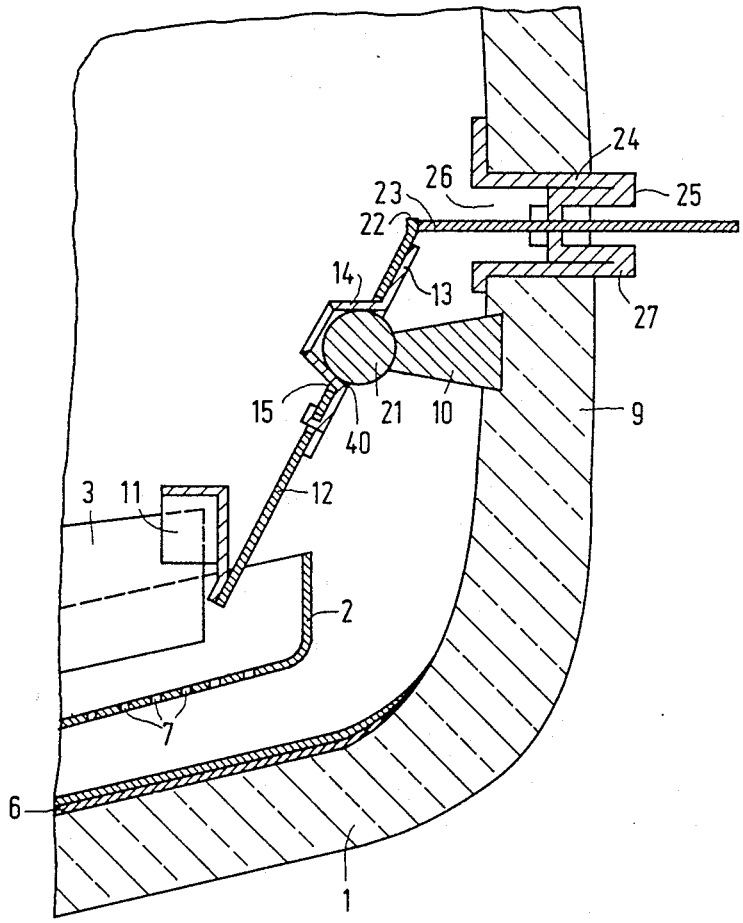
FIG. 3 is a diagrammatic sectional view of a part of an embodiment of a colour display tube after the envelope is formed, in which the shadow mask can be displaced relative to the display window by means of positioning members.

FIG. 2 diagrammatically shows one means for suspension of the shadow mask 2 in the display window 1. The display window 1, which is substantially rectangular in the present embodiment, has an upright edge 9 in which a support element, in the present embodiment a pin, 10 having a free end 21, is provided in each corner. In this embodiment the shadow mask 2 is secured to a frame 3 and is provided with a connection element 8 which comprises a resilient element 12 secured to a support strip 11 and a slide plate 13 having an aperture 40 (see FIG. 3). The slide plate 13 is provided with a conical portion 14 which engages in a slotted aperture 15 of the flat resilient element 12 with some play. The slide plate 13 is provided with two bent lugs 16, 17, which engage with some play in two further slotted apertures 18, 19 which are provided in the flat resilient element 12, and a support portion 20. The shadow mask 2 is suspended in the display window 1 in such a manner that the free end 21 of the pin 10 projects from the aperture 40 of the slide plate 13 and the conical portion 14 of the slide plate 13 lies against the free end 21 of the pin 10 (see FIG. 3).

Figure 4:
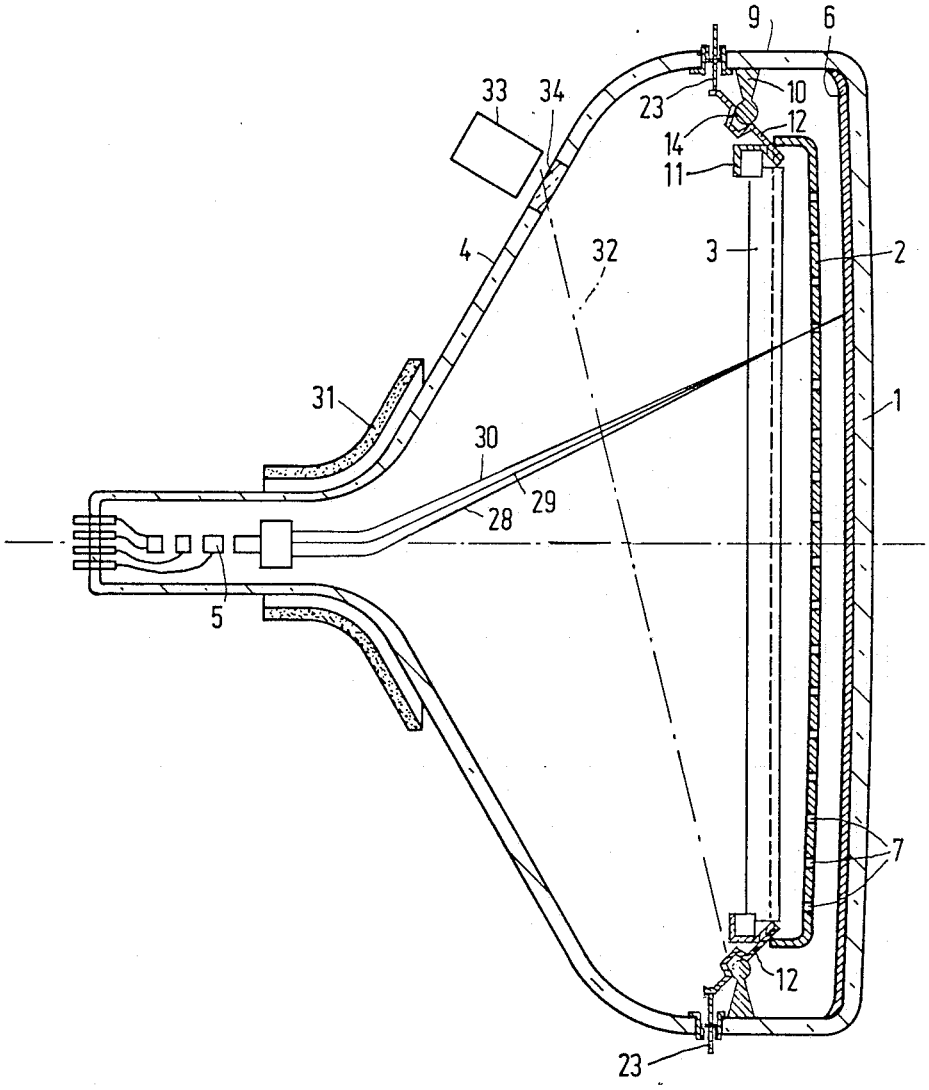
FIG. 4 is a diagrammatic sectional view of a colour display tube after the envelope is formed.

In an alternative embodiment, the shadow mask can also be suspended in the display window without making use of a frame. Any tolerances occurring during suspending the shadow mask 2 are compensated by the slide plate 13. After the shadow mask 2 is suspended, the resilient element 12 is secured to a positioning element, herein a positioning member 23, which extends through an aperture 26 in the upright edge 9 of the display window 1 into the interior of the display window 1. A free end of the positioning member 23 is secured, for example, to a bent portion 22 of the flat resilient element 12, for example, by a number of laser welds. The aperture 26 is sealed in a vacuum tight manner by means of an elastic element 27. Subsequently, the conical enveloping part 4 is secured to the display window 1, with glass frit being disposed therebetween, to form an envelope (FIG. 4). It is alternatively possible to secure the positioning elements directly to the shadow mask or to the frame to which the shadow mask is secured. Directly securing the positioning elements to the shadow mask must be carried out with due care to avoid local deformation in the shadow mask during securing and operating the shadow mask.

Subsequently, the shadow mask 2 is displaced relative to the display screen 6, and its position can be adjusted in any direction. The accuracy of registration of the mask with the screen can be determined by means of a test pattern generated by the electron beams 28, 29, and 30 which are deflected across the display screen 6 by means of a deflection system 31 and which impinges on the phosphor elements of the display screen 6 via the apertures 7 of the shadow mask 2 (FIG. 4). The displacement of the shadow mask 2 is carried out by mechanically moving the positioning members 23, which is made possible by the elastic elements 27, and which movement results in a displacement of the resilient element 12 relative to the slide plate 13 and the pin 10. Due to this, the apertures 7 of the shadow mask 2 move relative to the phosphor elements of the display screen 6. By moving the positioning members 23 such that a desired test pattern is displayed, an accurate positioning of the shadow mask 2 relative to the display screen 6 is obtained. The adjusted position of the shadow mask 2 is then fixed by securing the resilient element 12 to the slide plate 13 by, for example, a number of laser welds, and by securing the slide plate 13 to the pin 10. A laser beam 32 is generated for this purpose by a laser 33 and is passed through a light-transmitting window 34 which is provided in the conical enveloping part 4.

Figure 5:
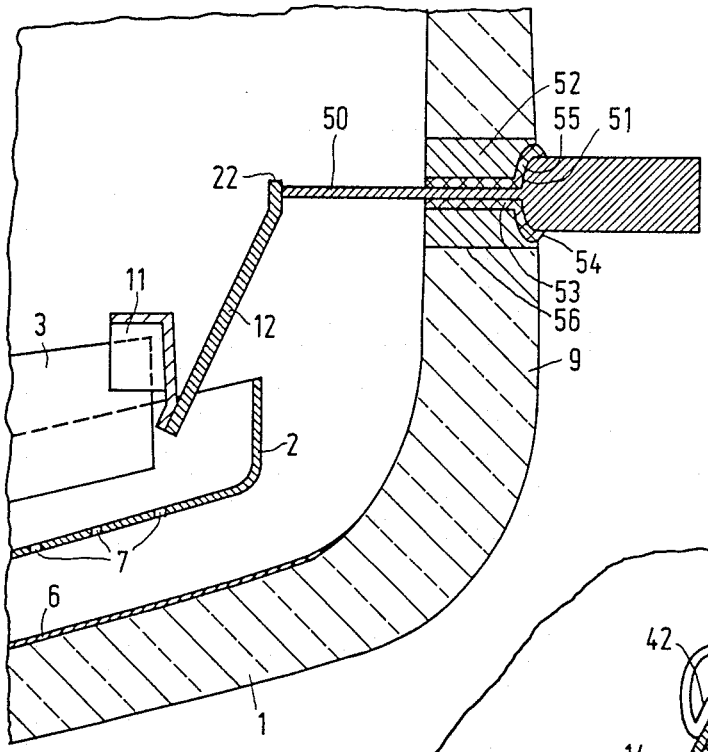
FIG. 5 is a diagrammatic sectional view of an embodiment of a part of a colour display tube after the envelope is formed, in which the shadow mask is suspended from movable positioning members in the display window.
Figure 6:
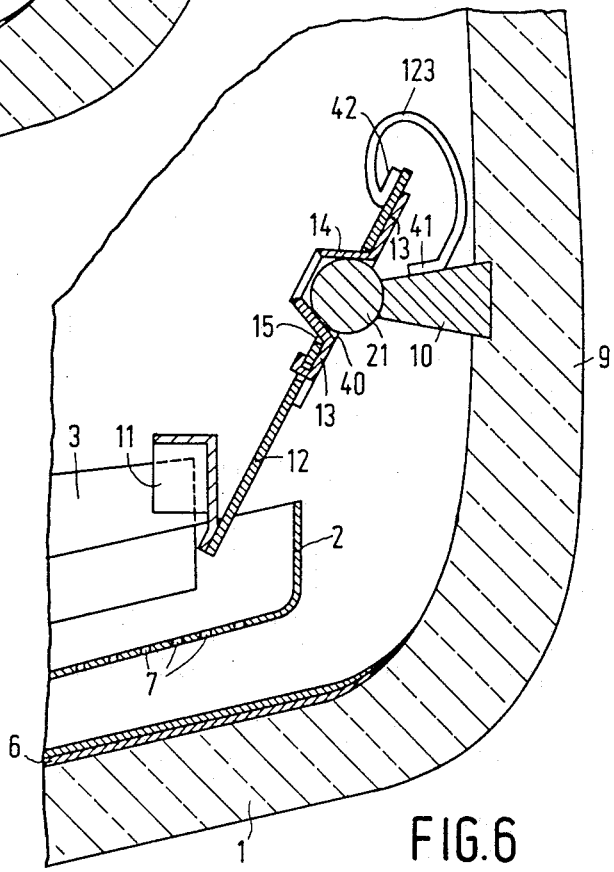
FIG. 6 is a diagrammatic sectional view of a part of an embodiment of a colour display tube after the envelope is formed, in which the shadow mask can be displayed relative to the display window by energy supplying means.

An alternative embodiment of a method in accordance with the invention, in which the support elements used to suspend the shadow mask 2 are formed by the positioning members is diagrammatically shown in FIG. 5. Each positioning member 50 is provided with a spherical portion 51. An aperture 53 and an at least partly spherical recess 54 are formed in a metal annular part 52. The positioning member 50 is slid into the aperture 53 until the spherical part 52 lies against the recess 54. The aperture 53 is sealed in a vacuum tight manner by means of an elastic element, for example a lead connection 55. Subsequently, the metal part 52 and the positioning member 50 are fitted in an aperture 56 of the upright edge 9 of the display window 1 by means of a vacuum tight connection. In this embodiment, the shadow mask 2 is suspended by securing a bent portion 22 of the resilient element 12 to the positioning member 50. A conical enveloping part 4 is secured to the display window 1 such that an envelope is formed which is then evacuated. By means of the movable positioning members 50 the shadow mask 2 is displayed relative to the display screen 6 until a desired test pattern is displayed, as is described hereinbefore. The positioning member 50 can be moved by virture of the deformability within certain limits of the lead connection. A vacuum tight connection being maintained. The adjusted position is fixed by fixing the free end of the positioning member 50 relative to the upright edge 9, for example, by means of a curable synthetic resin or glass frit.

An alternative preferred embodiment of a method in accordance within the invention, in which the shadow mask can be displaced relative to the display window after the envelope is formed, is shown in FIGS. 6 through 10. Means 123 is secured by its end 41 to the pin 10 (see FIG. 6). After the shadow mask 2 has been suspended, the other end 42 of the means 123 is secured to the resilient element 12, for example, by means of a number of laser welds. The invention is not limited to securing the means 123 to the pin 10. In an alternative embodiment, the means 123 may for example be secured to the upright edge 9 of the display window 1.

Figure 7:
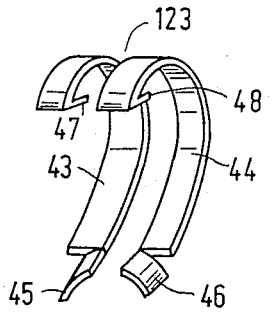
FIGS. 7 and 8 are diagrammatic perspective views of two different embodiments of movable positioning elements.
Figure 8:
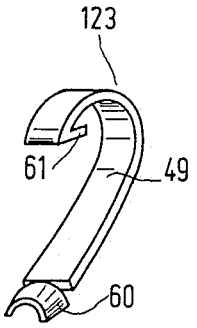

Means 123 bring about a displacement of the shadow mask 2 relative to the display window 1 as a function of a localised supply of energy to the means 123. FIGS. 7 and 8 are perspective views of two embodiments of means 123. In FIG. 7 the means 123 is formed by two juxtaposed, spaced apart, identical metal strips 43 and 44 which are secured with their ends 45, 46 to a pin which is secured in the display window. With their other ends 47 and 48 the metal strips 43 and 44 are fitted to the flat resilient element. In FIG. 8 the means 123 is formed by a bimetal strip 49 which is secured to a pin and a resilient element with its ends 60 and 61, respectively.

Figure 9:
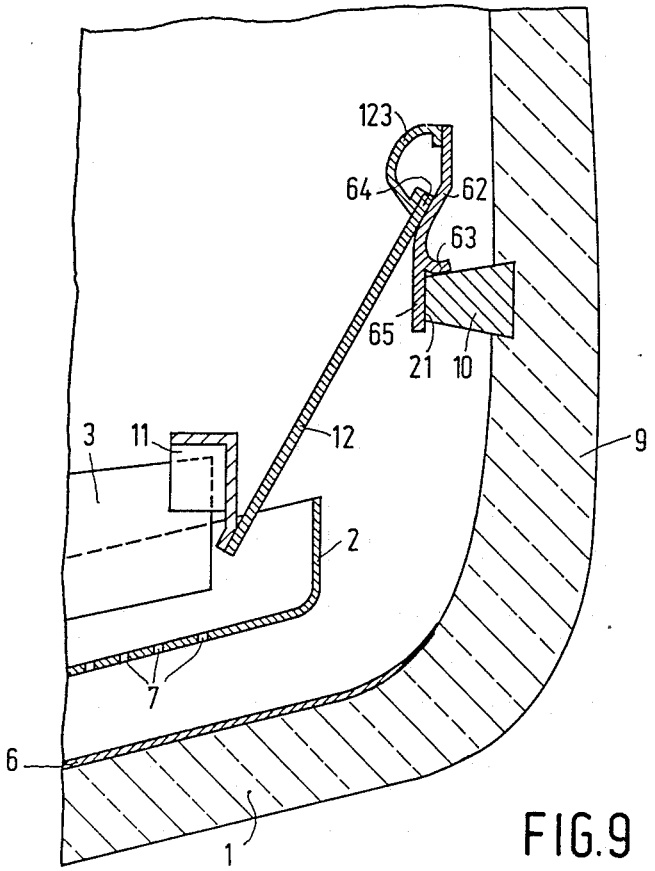
FIG. 9 is a diagrammatic sectional view of an embodiment of a means for suspension of the shadow mask in the display window.

FIG. 9 is a diagrammatic sectional view of another embodiment means for a suspension of the shadow mask, which can allow displacement relative to the display window. Each connection element comprises a resilient element 12 which is secured to the shadow mask 2, and the display window 1 is provided with a pin 10 having a free end 21. Before the shadow mask 2 is suspended in the display window 1, means 123 are secured to the resilient element 12, for example by means of a number of laser welds at the level of 64. A metal part 62 is fitted to the means 123. This metal part 62 is provided with a bent portion 63 and a portion 65. The shadow mask 2 is suspended in the display window 1 such that the metal part 62 lies between the pin 10 and the resilient element 12. The bent portion 63 prevents the shadow mask 2 from lying against the display screen 6. The shadow mask 2 is secured to the display window 1 by securing the portion 65 to the free end 21 of the pin 10, for example by means of a number of laser welds.

Figure 10:
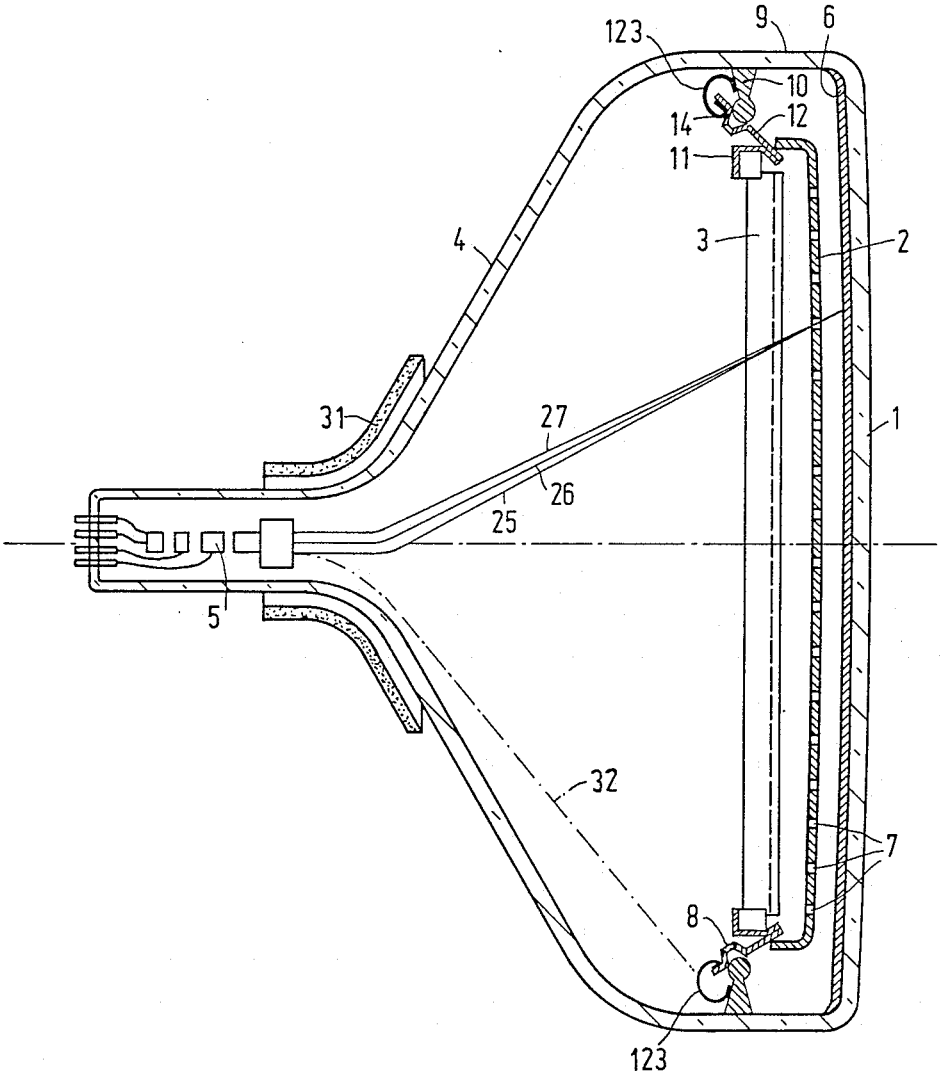
FIG. 10 is a diagrammatic sectional view of a colour display tube after the envelope is formed.

When the shadow mask 2 is suspended in the display window 1, a conical enveloping part 4 is secured to the display window 1, with glass frit being disposed therebetween, such that an envelope is formed which is subsequently evacuated (FIG. 10).

To adjust the position of the shadow mask 2 relative to the display window 1 a test pattern is displayed on the display screen 6 and is optimized, for example, as follows.

The test pattern displayed on the display screen 6 is accurately examined and, dependent on, for example, the colour errors the direction and the magnitude of the displacement of the shadow mask 2 necessary for accurately positioning the apertures 7 of the shadow mask 2 relative to the phosphor elements of the display screen 6 can be determined. The displacement of the shadow mask 2 relative to the display window 1 is carried out by locally applying heating energy to the means 123. This application of energy can be carried out by means of a laser (not shown) which directs a laser beam to the means 123 via a light-transmitting window in the conical enveloping part 4. However, the energy is preferably applied through an electron beam 32 which is generated by the electrode system 5. In this way an elegant manner of manufacturing a colour display tube is obtained, in which as few elements as possible are used. By locally applying energy to the means 123, these means are heated locally and, consequently, they expand, thereby causing the means 123 to move. If, for example, the embodiment in accordance with FIG. 7 is used and the strip 43 is heated by applying energy, the length and shape of strip 43 change relative to the (unheated) strip 44. Owing to this change in length the resilient element 12 in the embodiment shown in FIG. 2 and the slide plate 13 are displaced relative to the pin 10, or in the embodiment shown in FIG. 9 the resilient element is displaced relative to the metal part 62.

The shape of the means 123 is selected such that a specific desired positional change of the shadow mask 2 relative to the display screen 6 can be obtained by applying energy to a defined spot on the means. For this purpose, the means 123 may have many shapes and the shapes shown in the Figures are not to be regarded as limitative.

When the shadow mask 2 is aligned relative to the display screen 6, such that an optimum test pattern is displayed, the adjusted postion of the shadow mask is fixed by securing the resilient element 12, as shown in FIG. 2, to the slide plate 13 by means of a laser beam, and by securing the slide plate 13 to the pin 10 or, as is shown in FIG. 9, by securing the resilient element 12 to the metal part 62.

The method in accordance with the invention enables, inter alia, an inaccurately aligned shadow mask to be accurately aligned relative to the display window after the colour display tube has been assembled.

It will be understood that the invention is not limited to the embodiments described herein, and that many variations are possible to those skilled in the art without departing from the scope of the invention.

We claim:

1. A method of manufacturing a colour display tube, in which a display window is provided with a display screen of phosphor elements luminescing in different colours, a shadow mask having a large number of apertures is suspended in the display window, and an enveloping part is secured to the display window in such a way that an envelope is formed, characterized in that after the envelope is formed, the shadow mask is displaced relative to the display window by means of movable positioning elements, until the shadow mask is in a desired position, after which the mask position is fixed.

2. A method as claimed in claim 1, in which a test pattern generated by the tube is displayed on the display screen via the shadow mask, and in that the mask is displaced until a desired test pattern is displayed.

3. A method as claimed in claim 1 or 2, in which the shadow mask is provided with connection means for connecting the shadow mask to the movable positioning elements, and in that the shadow mask is displaced by displacing the connection means.

4. A method as claimed in claim 3, in which the shadow mask is suspended from support elements which are arranged in the display window, and are in contact with the connecting means, wherein during the displacement each connection means remains in contact with the associated support element, and the desired position is fixed by connecting each connection means to the associated support element.

5. A method as claimed in claim 4, in which each connection means comprises a resilient element and a slide plate with an aperture, which slide plate can be moved relative to the resilient element, and each of the support elements comprises a pin fitted in the display window and having a free end, the free end of the pin engages and projects from the aperture in the slide plate, and the position is fixed by fixing each slide plate to the associated pin.

6. A method as claimed in claim 5, in which each slide plate is secured to the associated resailient element and the associated pin by means of laser welds.

7. A method as claimed in claim 1, characterized in which the positioning elements each extend through an aperture in the envelope, and the position of the shadow mask is fixed by fixing the positioning elements relative to the envelope.

8. A method as claimed in claim 7, in which the positioning elements are used as the support elements from which the shadow mask is suspended in the display window.

9. A method as claimed in claim 7 in which the display window is provided with apertured recesses which are at least partly spherical, each of the positioning members is provided with an at least partly spherical portion which fits in a recess, and each aperture is sealed in a vacuum tight manner by an elastic element.

10. A method as claimed in claim 1, in which the positioning elements displace the shadow mask relative to the display window as a function of a localised supply of energy.

11. A method as claimed in claim 10, in which the supply of energy takes place as a function of irradiation by an electron beam generated by an electrode system which is accommondated in the enveloping part.

12. A method as claimed in claim 10 in which each of the positioning elements is composed of two juxtaposed, spaced apart metal strips, one end of the strips being connected to the display window and the other end being connected to the associated connection means.

13. A method as claimed in claim 12 in which each support element is provided with a metal part, and one end of each strip, is secured to this metal part and the other end of each strip being secured to the associated connection means, the connection means lying against the metal part, the desired position of the shadow mask is fixed by securing each connection means to the associated metal part.

14. A method as claimed in claim 13, in which the desired position is fixed by means of laser welds.

15. A method as claimed in claim 10 in which each of the positioning elements is composed of a bimetal strip, one end of the strip being connected to the display window and the other end being connected to the shadow mask.

* * * * *